United States Patent [19]

Tutihasi

[11] 4,254,199

[45] Mar. 3, 1981

[54] ELECTROPHOTOGRAPHIC IMAGING METHOD HAVING A DOUBLE CHARGING SEQUENCE

[75] Inventor: Simpei Tutihasi, Webster, N.Y.

[73] Assignee: Xerox Corporation, Stamford, Conn.

[21] Appl. No.: 128,776

[22] Filed: Mar. 10, 1980

Related U.S. Application Data

[63] Continuation of Ser. No. 881,262, Feb. 24, 1978, abandoned.

[51] Int. Cl.[3] ..... G03G 5/10; G03G 5/14

[52] U.S. Cl. ..... 430/58; 430/55; 430/60; 430/67

[58] Field of Search ..... 430/54, 58, 60, 67, 430/55; 340/173 PP; 365/146

[56] References Cited

U.S. PATENT DOCUMENTS

| | | | |
|---|---|---|---|
| 3,041,167 | 6/1962 | Blakney et al. | 430/67 X |
| 3,676,117 | 7/1972 | Kinoshita | 430/51 |
| 3,677,751 | 7/1972 | Ohta | 430/67 X |
| 3,953,207 | 4/1976 | Horgan | 430/58 |
| 4,123,269 | 10/1978 | Von Hoewe et al. | 430/60 |

OTHER PUBLICATIONS

Nakamura I.E.E.E. Transactions on Electron Devices, vol. Ed 19, No. 4, Apr. 1972.

*Primary Examiner*—Mayer Weinblatt
*Assistant Examiner*—John L. Goodrow
*Attorney, Agent, or Firm*—H. M. Brownout; P. H. Kondo; E. O. Palazzo

[57] ABSTRACT

There is described an electrophotographic imaging method which utilizes an imaging member comprising a substrate, a layer of a charge carrier injecting material, a layer of a charge carrier transport material, a layer of a photoconductive charge carrier generating material and an electrically insulating overcoating layer. In operation, the member is charged a first time with electrostatic charges of a first polarity, charged a second time with electrostatic charges of a polarity opposite to said first polarity in order to substantially neutralize the charges residing on the electrically insulating surface of the member and exposed to an imagewise pattern of activating electromagnetic radiation whereby an electrostatic latent image is formed. The electrostatic latent image may be developed to form a visible image which may be transferred to a receiver member. Subsequently the imaging member may be reused to form additional reproductions after erasure and cleaning steps are carried out.

5 Claims, 4 Drawing Figures

ELECTROPHOTOGRAPHIC IMAGING METHOD HAVING A DOUBLE CHARGING SEQUENCE

This is a continuation of application Ser. No. 881,262, filed Feb. 24, 1978, now abandoned.

BACKGROUND OF THE INVENTION

This invention is directed to an electrophotographic imaging method and more particularly to a method employing an overcoated electrophotographic imaging member.

The formation and development of images on the imaging surfaces of photoconductive materials by electrostatic means is well known. The best known of the commercial processes, more commonly known as xerography, involves forming an electrostatic latent image on the imaging surface of an imaging member by first uniformly electrostatically charging the surface of the imaging layer in the dark and then exposing this electrostatically charged surface to an imagewise pattern of activating electromagnetic radiation. The light-struck areas of the imaging layer are thus rendered relatively conductive and the electrostatic charge is selectively dissipated in these irradiated areas. After the photoconductor is exposed, the electrostatic latent image on this image bearing surface is typically rendered visible with a finely divided colored marking material, known in the art as "toner". This toner will be principally attracted to those areas on the image bearing surface which retain the electrostatic charge and thus form a visible powder image. The electrostatic latent image may also be used in a host of other ways as, for example, electrostatic scanning systems may be employed to "read" the latent image or the latent image may be transferred to other materials by TESI techniques and stored. A developed image can be read or permanently affixed to the photoconductor where the imaging layer is not to be reused.

In the commercial "plain paper" copying systems, the latent image is typically developed on the surface of a reusable photoreceptor, subsequently transferred to a sheet of paper and then permanently affixed thereto to form a permanent reproduction of the original object. The imaging surface of the photoreceptor is then cleaned of any residual toner and additional reproductions of the same or other original objects can be made thereon.

Various types of photoreceptors are known for use in electrophotographic copying machines. For example, there are known in the art photoreceptors wherein the charge carrier generation and charge carrier transport functions are performed by discrete contiguous layers. There are also known in the art photoreceptors which include an overcoating layer of an electrically insulating polymeric material. In conjunction with such so-called "overcoated" photoreceptors there have been proposed a number of imaging methods. Nevertheless, as the art of xerography advances and more stringent demands are imposed upon the carrying apparatus because of increased performance standards there continue to be discovered novel imaging methods. The present application relates to a novel electrophotographic imaging method which utilizes an overcoated electrophotographic imaging member.

PRIOR ART STATEMENT

U.S. Pat. No. 3,041,167 discloses an electrophotographic imaging method which utilizes an overcoated imaging member comprising a conductive substrate, a photoconductive insulating layer and an overcoating layer of an electrically insulating polymeric material.

In operation, the member is utilized in a repetitive electrophotographic copying method wherein initially the member is charged with an electrostatic charge of a first polarity and imagewise exposed to form electrostatic latent image which is then developed to form a visible image. The visible image is transferred to a receiver member and the surface of the imaging member is cleaned to complete the imaging cycle. Prior to each succeeding cycle, the imaging member is charged with an electrostatic charge of a second polarity which is opposite in polarity to said first polarity. Enough additional charges of the second polarity are applied to create across the member a net electrical field of said second polarity. At the same time mobile charges of said first polarity are created in the photoconductive layer such as by applying an electrical potential to the conductive substrate. In this method, the imaging potential which is developed to form the visible image is present across the photoconductive layer and the overcoating layer.

An article by Nakamura an IEEE Transactions On Electron Devices, Vol. ED19, No. 4, April 1972 discloses various techniques for forming images on overcoated photoreceptors comprising a conductive substrate, a photoconductive insulating layer and an overcoating layer of an electrically insulating polymeric material. In Technique #1 the member is charged a first time with electrostatic charges of a first polarity, charged a second time with electrostatic charges of the opposite polarity to neutralize the previous charges deposited on the member, imagewise exposed and developed.

SUMMARY OF THE INVENTION

It is therefore the object of this invention to provide a novel electrophotographic imaging method.

It is another object of the invention to provide an imaging method which utilizes an overcoated photoreceptor which includes a layer of a photoconductive charge carrier generator material and a layer of a charge carrier transport material.

It is a further object of the invention to provide an electrophotographic imaging method wherein the imaging potential is created across the charge carrier generator and charge carrier transport layers only.

BRIEF SUMMARY OF THE INVENTION

These and other objects and advantages are accomplished in accordance with the invention by providing an electrophotographic method which utilizes an imaging member comprising a substrate, a layer of a charge carrier injecting material, a layer of a charge carrier transport material, a layer of a photoconductive charge carrier generating material and an electrically insulating overcoating layer. In operation, the member is charged a first time with electrostatic charges of a first polarity, charged a second time with electrostatic charges of a polarity opposite to said first polarity in order to substantially neutralize the charges residing on the electrically insulating surface of the member and exposed to an imagewise pattern of activating electromagnetic radiation whereby an electrostatic latent image is formed. The electrostatic latent image may be developed to form a visible image which may be transferred to a receiver member. Subsequently, the imaging member may be reused to form additional reproductions after erasure and cleaning steps are carried out.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
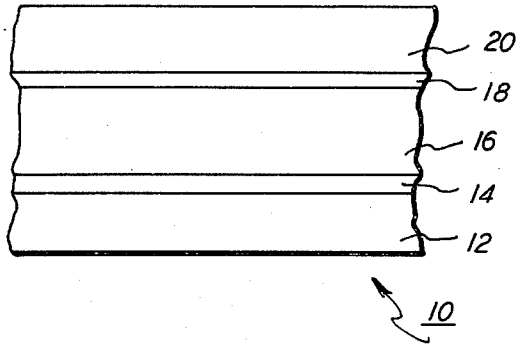
FIG. 1 is a partially schematic, cross-sectional view of a photoreceptor which may be utilized in the method of the invention.

Referring now to FIG. 1, there is illustrated a photoreceptor, generally designated 10 comprising a substrate 12, a layer of charge carrier injecting material 14, a layer of charge carrier transport material 16, a layer of photoconductive charge carrier generating material 18 and a layer of electrically insulating polymeric material 20.

Substrate 12 may be opaque or substantially transparent and may comprise any suitable material having the requisite mechanical properties. The substrate may comprise a layer of conductive material such as, for example, aluminum, brass or the like; or it may comprise a layer of non-conducting material such as an inorganic or organic polymeric material; or it may comprise a layer of an inorganic or organic material having a conductive surface layer arranged thereon. The substrate may be flexible to rigid and may have any of many different configurations such as, for example, a plate, a cylindrical drum, an endless flexible belt, etc. Preferably the substrate is in the form of an endless flexible belt. Charge carrier injecting layer 14 must be capable of injecting charge carriers into charge carrier transport layer 16 under the influence of an electrical field in the preferred embodiment of the invention. As will be discussed in detail below herein, the injected charge carriers must be of the same polarity as the mobile carriers preferentially transported by layer 16. In one embodiment, the charge carrier injecting layer may be sufficiently laterally conductive to also serve as the ground electrode for the photoreceptor in which case a separate additional conductive layer is not required. In another embodiment, an additional discrete conductive layer as required to provide the necessary electrical field when the photoreceptor is charged. In such a configuration, the conductive layer is arranged below the charge carrier injecting layer and conveniently can be provided as an integral part of the substrate.

Typical suitable materials which are capable of injecting charge carriers under the influence of an electrical field and therefore are suitable for use in layer 14 include gold, graphite, aluminum, indium and the like. Gold and graphite are hole injecting materials; aluminum and indium are electron injecting materials. Gold, aluminum and indium possess sufficient lateral conductivity so that they may also serve as the ground electrode as well as the charge carrier injecting material. Graphite typically does not have the requisite lateral conductivity to serve as the ground electrode and an additional conductive layer is required in conjunction therewith. Typically, charge carrier injecting layer 14 has a thickness in the range of from about 0.1 to about 10 microns or more. The maximum thickness in any specific instance is generally determined by mechanical considerations; in flexible photoreceptors, for example, the charge carrier injecting layer is typically very thin. The charge carrier injecting materials and charge carrier transport materials require a particular work function relationship in order for holes or electrons to be injected from the former into the latter. Generally hole injecting materials possess a relatively high work function whereas electron injecting materials possess a relatively low work function.

In another embodiment, the charge carrier injecting layer 14 comprises a material which will inject charge carriers when irradiated with appropriate electromagnetic radiation. In this embodiment, layer 14 may comprise any suitable photo-generating material known for use in electrophotography such as selenium and the like.

Charge carrier transport layer 16 may comprise any suitable material capable of transporting at least one species of charge carrier. Preferably layer 16 comprises a material which is capable of transporting only one species of charge carrier. Layer 16 typically has a thickness in the range of from about 5 to about 50 microns and preferably from about 30 to about 40 microns. The layer preferably comprises a material having no photoconductive properties or which has photoconductive properties in a spectral region which is completely obscured by the superimposed photogenerator material in layer 18 and overcoating material in layer 20 since it is desired to have layer 18 perform the charge carrier photogeneration function substantially completely. To this end the materials in layers 18 and 20 and the light source utilized in the method are generally selected so as to preclude any substantial photoexcitation of the charge carrier transport material. It is preferred to utilize a charge carrier transport material which will transport only one species of charge carrier because, as will become apparent from the discussion below, this type of material eliminates constraints which would have to be placed on the selection of the charge carrier injecting material otherwise.

As mentioned previously, layer 16 must be able to accept charge carriers injected from injecting layer 14. In addition, layer 16 must be able to accept and transport charge carriers which are generated by charge carrier generating layer 18 upon irradiation thereof with appropriate illumination. Moreover, as will be discussed in detail below herein, charge carriers must be able to travel across the interface between layers 16 and 18 without hindrance in both directions in order to have the member function in a repeating cyclic mode.

The charge carrier transport layer may be a polymeric film of a charge carrier transporting material or a monomeric charge carrier transport material incorporated in a solid solution with an electrically insulating inert polymeric binder material. Solid solution systems typically have about 30%-50% by weight of the monomeric transport material in order to enable rapid and efficient transport of charge carriers. It is possible to have a lesser amount of the monomer where the binder material itself is capable of transporting charge carriers. By "inert" is meant a material which is relatively incapable of independently generating charge carriers in response to the electromagnetic radiation within the spectral range employed in the electrophotographic imaging method and/or transporting charge carriers which are injected into its bulk from another source. Typical suitable polymeric charge carrier transporting materials include, for example, poly(N-vinylcarbazole), poly(2-vinylcarbazole), poly(3-vinylcarbazole), poly(3-vinylpyrene), poly(2-anthrylmethacrylate) and poly(9-vinylanthracene). Typical suitable monomeric charge carrier transporting materials are disclosed in U.S. Pat. Nos. 3,573,906 and 3,870,516, the disclosures of which are incorporated herein. Typical suitable inert polymeric resins which may be used as solid solution matrices for monomeric charge carrier transport materials include, for example, polyolefins, polycarbonates, polysiloxanes, copolymers, blends and mixtures thereof.

There are known charge carrier transport materials which will transport both species of charge carriers such as, for example, complexes of poly(N-vinylcarbazole) and 2,4,7-trinitro-9-fluorenone (TNF). There are also known charge carrier transport materials which transport primarily only holes such as, for example, triphenylamine or only electrons such as, for example, TNF. The selection of a transport material for use in a particular photoreceptor is dependent upon various factors such as the polarity of the electrostatic charges deposited in the first charging step, the ability to accept charge carriers injected from layer 14, the ability to accept charge carriers generated by layer 18 and the ability to form an interface with layer 18 which will allow charge carriers to travel across the interface in both directions.

Photoconductive charge carrier generating layer 18 generally may comprise any photoconductive charge carrier generating material known for use in electrophotography provided it is electronically compatible with charge carrier transport layer 16, that is, it can inject photoexcited charge carriers into the transport layer and charge carriers can travel in both directions across the interface between the two layers. Particularly preferred photoconductive charge carrier generating materials include amorphous and trigonal selenium, selenium-arsenic and selenium-tellurium alloys and organic charge carrier generating materials such as phthalocyanine. Layer 18 is typically from about 0.5 to about 10 microns or more in thickness. Generally, it is desired to provide this layer in a thickness which is sufficient to absorb at least 90% (or more) of the incident radiation which is directed upon it in the imagewise exposure step. The maximum thickness is dependent primarily on factors such as mechanical considerations, e.g. whether a flexible photoreceptor is desired.

Electrically insulating overcoating layer 20 typically has a bulk resistivity of from about $10^{12}$ to about $5\times10^{-}$ohm-cm and typically is from about 5 to about 25 microns in thickness. Generally, this layer provides a protective function in that the charge carrier generating layer is kept from being contacted by toner and ozone which is generated during the imaging cycle. The overcoating layer also must prevent charges from penetrating through it into charge carrier generating layer 18 or from being injected into it by the latter. Preferably, therefore layer 20 comprises materials having higher bulk resistivities. Generally, the minimum thickness of the layer in any instance is determined by the functions the layer must provide whereas the maximum thickness is determined by mechanical considerations and the resolution capability desired for the photoreceptor. Typical suitable materials include Mylar (a polyethylene terephthalate film available from E. I. duPont de Nemours), polyethylenes, polycarbonates, polystyrenes, polyesters, polyurethanes and the like. The particular material selected in any instance should not be one which will dissolve or react with the materials used in layers 16 and 18.

The formation of the electrically insulating layer 20 over the previous layer may be carried out by solution coating in which case no additional materials are required. Where layer 20 constitutes a preformed mechanically tough film, it is typically necessary to provide sufficient adhesive material in order to provide an integral structure which is desirable for use in a repetitive imaging method. The electrical properties of any such adhesive interlayer should be similar to those of the overcoating. Alternatively, they may be similar to the binder material of the charge carrier generating layer 18 where a binder material is present in that layer. Mechanically, the adhesive interlayer should provide an adhesive state that firmly binds the layers together without any air gaps or the like which could disturb image definition.

Figure 2A:
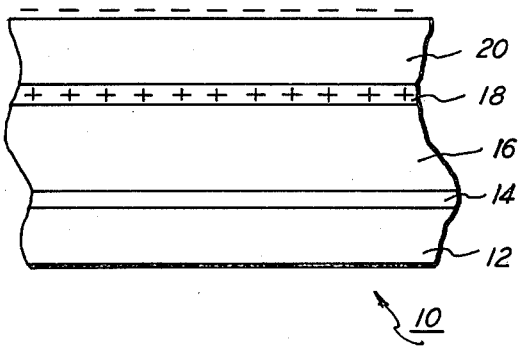
FIGS. 2A–2C illustrate the various method steps employed.
Figure 2B:
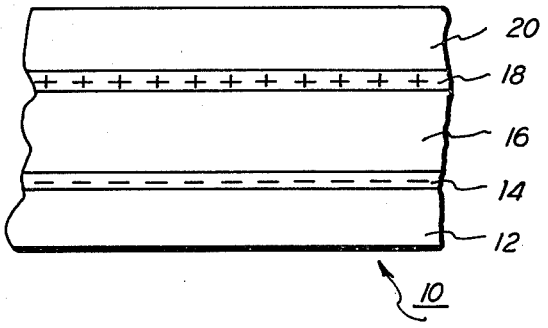
Figure 2C:
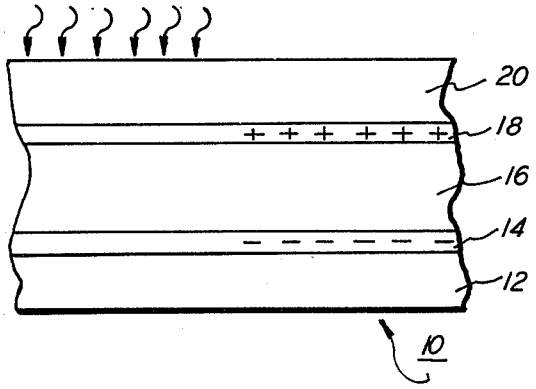

The operation of the member is illustrated with respect to FIGS. 2A–2C. In this illustrative explanation the charge carrier injecting material which comprises layer 14 is a hole injecting material and the initial charging step is carried out with negative polarity. As noted previously, the method is not limited to this embodiment. Moreover, the description of the method will be given in conjunction with the proposed theoretical mechanism by which the method is thought to be operative in order to better aid those skilled in the art to understand and practice the invention. It should be noted however that the method has been proved to be operable and highly effective through actual experimentation and any inaccuracy in the proposed theoretical mechanism of operation is not to be constructed as being limiting of the invention.

Referring now to FIG. 2A, there is seen the condition of the photoreceptor after it has been electrically charged negatively a first time in the absence of illumination by any suitable electrostatic charging apparatus such as a corotron. The negative charges reside on the surface of electrically insulating layer 20. As a consequence of the charging an electrical field is established across the photoreceptor and as a consequence of the electrical field holes are injected from the charge carrier injecting layer into the charge carrier transport layer. The holes injected into the charge carrier transport layer are transported through the layer, enter into the charge carrier generating layer 18, and travel through the latter until they reach the interface between the charge carrier generating layer 18 and the electrically insulating layer where they become trapped. The charges thus trapped at the interface establish an electrical field across the electrically insulating layer 20. Thus, it is seen that in the embodiment where negative charging is carried out in the first charging step charge carrier injecting layer 14 and charge carrier transport layer 16 must comprise materials which will allow injection of holes from the former into the latter and charge transport layer 16 preferably comprises material which will predominantly transport holes. Also, it can be seen that the charge carrier transport layer 16 and the charge carrier generating layer 18 must comprise materials which will allow injection of holes from the former into the latter and allow the holes to reach the interface between layer 18 and electrically insulating layer 20.

Generally, the charging step is carried out with a voltage in the range of from about 10 volts/micron to about 100 volts/micron.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage based on the dielectric thickness ratio of the overcoating layer 20 to the total of the charge carrier transport and charge carrier generating layers, 16 and 18 respectively. By "substantially neutralized" within the context of this invention is meant that the voltage across the photoreceptor member, upon illumination of the photoreceptor, may be brought to substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at that interface at the end of the second charging step. However, there is now a uniform layer of negative charges located at the interface between layers 14 and 16.

Therefore, it can be seen that the net result of the second charging step is to establish a uniform electrical field across the charge carrier transport and charge carrier generating layers. To achieve this result it is critical that the negative charges be located at the interface between charge carrier injecting layer 14 and charge carrier transport layer 16 and prevented from entering into the transport layer. For this reason it is preferred to utilize a charge carrier transport material which will transport only one species of charge carrier, holes in this illustrative instance. Where a charge carrier transport material capable of transporting both species of charge carriers is employed in layer 16 it is apparent that the charge carrier injecting material would have to be selected so that the latter would be unable to inject electrons in layer 16 thus placing constraints on the selection of materials.

Subsequently, the member is exposed to an imagewise pattern of electromagnetic radiation to which the charge carrier generating material comprising layer 18 is responsive. The exposure of the member may be effected through the substrate or the electrically insulating overcoating. As a result of the imagewise exposure an electrostatic latent image is formed in the photoreceptor. This is because hole-electron pairs are generated in the light-struck areas of the charge carrier generating layer. The light-generated holes are injected into the charge carrier transport layer and travel through it to be neutralized by the negative charges located at the interface between layers 14 and 16 whereas the light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination whereas the electrical field across the same layers in the areas which did receive illumination is discharged to some low level.

It is readily apparent from the foregoing that charge carriers of one species must be able to pass in both directions across the interface of between charge carrier transport layer 16 and charge carrier generating layer 18 in order to form an electrostatic latent image in the member. Laboratory experiments have shown that this condition may not always be satisfied. For example, it has been found that an amorphous selenium generator layer would inject holes into a charge carrier transport layer comprising N-isopropyl carbazole in a polycarbonate binder material but that holes did not inject from the transport layer into the generator layer.

A convenient technique has been devised to test combinations of charge carrier generator and charge carrier transport materials in order to determine if the requisite bi-directional charge carrier travel occurs. Initially, a sample is prepared including a charge carrier injecting layer, a charge carrier transport layer and a charge carrier generating layer. The charge carrier generating layer is provided in a thickness sufficient so that the capacitance division of an applied voltage across the sample can be calculated. For example, a sample can be prepared with a gold charge carrier injecting layer, a 32.2 micron thick charge carrier transport layer comprising N,N'-diphenyl-N,N'-bis(3-methylphenyl)-[1,1'-biphenyl]-4,4'-diamine in a polycarbonate binder and a 23.2 micron thick charge carrier generating layer comprising selenium. In such a sample, approximately three quarters of the voltage drop would be across the transport layer. Initially, the sample is charged to a potential of +2400 volts. The sample is then illuminated from above with activating electromagnetic radiation. The field across the sample is discharged to substantially zero. Therefore, it can be concluded that holes inject from the selenium layer into the charge carrier transport material and travel through the entire thickness of the layer to discharge the field. If the holes were not injected from the generating layer into the transport layer a measurable voltage across the transport layer would result. Subsequently, the sample is charged in the dark with negative polarity using the same corotron voltage. After this charging step, no substantial voltage can be measured. Therefore, it is concluded that holes are injected from the gold layer into the transport layer, travel across the latter and enter into the charge carrier generating layer. Accordingly, the requisite bi-directional charge carrier travel occurs. If after the second charging step it is possible to measure a voltage which would be predicted by the voltage division between the charge carrier carrier generating and transport layer then it can be concluded that holes did not travel across the interface between these layers and the combination would not be appropriate for use in a photoreceptor according to the method of the invention. Any combination of charge carrier generating and charge carrier transport materials can be tested according to this general procedure. The procedure thus represents a convenient way to determine suitable combinations of materials which will exhibit the requisite properties.

Another significant factor in selection of materials concerns the rate at which charge carriers are injected from the injecting material into the transport material with respect to the rate at which the charge carriers are transported through the latter. It is preferred to select a combination of materials such that the rate at which charge carriers are injected into the charge carrier transport layer exceeds the rate at which the charge carriers are transported through the transport layer and it is particularly preferred that the injection rate greatly exceed the transport rate.

When this condition is met, the electrical field which is responsible for causing charge carrier injection to occur will not diminish as rapidly as would otherwise be the case. Accordingly, charge carrier injection will be complete and bulk trapping of charge carriers can be avoided thus providing a more efficient method with desirable cycling characteristics. In the preferred embodiments, charge carrier injection is typically complete in less than a millisecond whereas charge carrier transport takes place between the order of a millisecond and tens of milliseconds. Where the injection/transport rates are reversed, a much less desirable condition can occur. In this case, injection would take place over a relatively long time period with each injected charge rapidly being transported away and diminishing the existing electrical field. Eventually, the electrical field would be so weak that only relatively sporadic and incomplete injection would take place and transport of the lattermost injected charges would be slowed. This could result in irreversible trapping of charges due to relatively long residence of the charges on the transport material molecules. Where this condition occurs the cycling characteristics of the method are unfavorably affected.

The electrostatic latent image formed in the member may be developed to form a visible image by any of the well known xerographic development techniques, for example, cascade, magnetic brush, liquid development, etc. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor is to be reused to make additional reproductions as is the case in a recyclible xerographic apparatus any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor while the photoconductive carrier generating layer is uniformly illuminated and grounded. For example, charge removal can be effected by A.C. corona discharge in the presence of illumination from a light source or preferably a grounded conductive brush could be brought into contact with the surface of the photoreceptor in the presence of such illumination. This latter mode also will remove any residual toner particles remaining on the surface of the photoreceptor.

In another embodiment the charge carrier injecting layer 14 comprises a material which will generate charge carriers when irradiated with appropriate electromagnetic radiation such as a layer of selenium. In this embodiment the substrate must include a conductive layer to serve as a ground electrode for the photoreceptor. In operation the photoreceptor is charged a first time and then uniformly illuminated through the substrate with suitable activating radiation. The illumination step may be simultaneously with or subsequent to the initial charging step. The remainder of the method is the same as described above.

The invention will now be described in detail with respect to specific preferred embodiments thereof by way of examples it being understood that these are intended to be illustrative only and the invention is not intended to be limited to the materials, conditions, process parameters, etc. recited therein. All parts and percentages are by weight unless otherwise indicated.

EXAMPLE I

A photoreceptor was fabricated by initially providing an aluminum sheet substrate approximately 6 mils in thickness. Subsequently, an approximately 25 micron thick layer of a charge carrier transport material comprising a 4:1 by weight mixture of PE-200 polyester resin (available from Goodyear Chemical) and X-form phthalocyanine was deposited on the aluminum layer by solvent coating from a methyl ethyl ketone and toluene solution. The member was then dried overnight in a vacuum oven at a temperature of about 50° C. An approximately 1 micron thick amorphous selenium layer was vacuum deposited over the transport layer followed by the formation of an approximately 15 micron thick layer of phenoxy insulating material by solvent coating from a solution of methyl ethyl ketone. The photoreceptor was then dried to remove any residual solvent.

The photoreceptor was charged a first time to a potential of −1200 volts and then charged a second time to a potential of +400 volts. The photoreceptor was then uniformly illuminated with 454 nm radiation obtained by passing the output from a tungsten lamp through an interference bandpass filter. Electrical measurements showed that the field across the photoreceptor was discharged to about zero potential thus indicating that the photoreceptor is suitable for use according to the method of the invention.

A 4″×4″ sample of the photoreceptor was prepared in the same manner described above. A xerographic reproduction was made with a Xerox Model D Processor using this sample as the photoreceptor. A readable reproduction was obtained.

EXAMPLE II

A photoreceptor was fabricated by initially vacuum depositing an approximately 200 Å thick gold layer on an aluminum sheet substrate such as was described in Example I. An approximately 25 micron thick layer of N,N′-diphenyl-N,N′-bis(3-methylphenyl)-[1,1′-biphenyl]-4,4′-diamine in a polycarbonate binder (1:1 ratio) was formed on the gold layer by solvent coating from a methylene chloride solution using a draw bar coating technique. The member was then dried in a vacuum oven at a temperature of about 70° C. for about 24 hours. An approximately 0.6 micron thick amorphous arsenic triselenide layer was vacuum deposited over the transport layer and an approximately ½ mil thick acrylic resin overcoating layer (Futura Floor Wax, available from Johnson & Johnson) was then placed over the arsenic triselenide layer and air dried for 24 hours.

The photoreceptor was charged a first time with a potential of −500 volts and then charged a second time with a potential of +1500 volts. The photoreceptor was then uniformly illuminated with white light. Electrical measurements showed that the field across the photoreceptor was discharged to substantially zero potential thus indicating that the photoreceptor is suitable for use according to the method of the invention.

EXAMPLE III

A photoreceptor similar to that described in Example II was made with the exception that the charge carrier generating layer was selenium instead of arsenic triselenide and the charge carrier transport layer was about 20 microns thick. The photoreceptor was charged a first time with a potential of −1300 volts, a second time with a potential of +1800 volts and then uniformly illuminated with white light. Electrical measurements showed that the photoreceptor was discharged to substantially zero potential thus indicating the photoreceptor is suitable for use according to the method of the invention.

EXAMPLE IV

A photoreceptor was fabricated by initially vacuum depositing an approximately 0.2 micron thick gold layer on an aluminum substrate. An approximately 20 micron thick charge carrier transport layer comprising N,N'-diphenyl-N,N'-bis(3-methylphenyl)-[1,1'-biphenyl]-4,4'-diamine in Makrolon (a polycarbonate available from Bayer Gesel) in a 1:1 ratio was then deposited over the gold layer by solvent coating from a methylene chloride solution. The member was then dried in a vacuum oven at a temperature of about 70° C. for about 24 hours. An approximately 1 micron thick selenium layer was vacuum deposited over the transport layer followed by the formation of an approximately 15 micron thick phenoxy overcoating layer by solvent coating from a solution of methyl ethyl ketone. The photoreceptor was then dried to remove any residual solvent.

The photoreceptor was charged a first time with a potential of −800 volts, a second time with a potential of +2000 volts and then uniformly illuminated with white light. Electrical measurements showed that the field across the photoreceptor was discharged to substantially zero thus indicating that the photoreceptor is suitable for use in the method of the invention.

A 4"×4" sample of the photoreceptor was prepared in the same manner described above. A xerographic reproduction was made with a Xerox Model D Processor using this sample as the photoreceptor. An excellent quality reproduction was obtained.

EXAMPLE V

A photoreceptor was fabricated using an approximately 5 mil thick Mylar substrate. A charge injecting composition was formed by preparing an 11% solution of Flexclad polyester resin (available from Goodyear) in chloroform, adding to it 11% by weight of graphite and ball milling the mixture for about 24 hours with steel shot. An approximately 3–5 micron thick layer of the composition was deposited on the Mylar substrate and the sample was then dried to remove residual solvent. An approximately 20 micron thick charge carrier transport layer made up of the composition used in Example IV was deposited over the charge carrier injecting layer by solvent coating from a methylene chloride solution. The sample was dried to remove residual solvent by placing it in a vacuum oven at a temperature of about 70° C. for about 24 hours. An approximately 0.5 micron thick layer of amorphous selenium was vacuum deposited over the transport layer. Finally, an approximately 1.5 mil thick layer of Mylar having a polyester adhesive preapplied thereto was laminated to the selenium layer with the polyester adhesive in contact with the selenium employing a Model 275 LM Laminator (available from General Binding Corporation, Northbrook, Ill.). The charge carrier injecting layer had sufficient lateral conductivity to also serve as the ground electrode for the photoreceptor.

Testing of this photoreceptor according to the method of the invention showed that it is suitable for use in such method.

EXAMPLE VI

A photoreceptor was fabricated by depositing on an approximately 6 mil thick aluminum substrate, an approximately 6 micron thick layer of the charge carrier injecting composition described in Example V by the same technique described in that example. An approximately 28 micron thick charge carrier transport layer of the same composition used in Example IV was deposited over the charge carrier injecting layer by solvent coating from a methylene chloride solution. The sample was then dried in a vacuum oven at a temperature of about 70° C. for about 24 hours.

A charge carrier generating composition was prepared by placing 0.7 gm of alpha-phthalocyanine and 1.5 gms of 49,000 polyester resin (available from E. I. duPont de Nemours) in methylene chloride and ball milling for about 24 hours. An approximately 3–4 micron thick layer of this composition was deposited over the transport layer by solvent coating using a draw bar coating technique. The sample was dried to remove residual solvent. Finally, an approximately 10 micron thick layer of Flexclad polyester resin was deposited over the charge carrier generating layer by solvent coating from methylene chloride solution using a draw bar coating technique. The sample was again dried to remove residual solvent.

The photoreceptor was charged a first time with a potential of −1200 volts, charged a second time with a potential of +2400 volts and then illuminated with white light. Electrical measurements showed that the field across the photoreceptor was discharged to substantially zero thus indicating that the photoreceptor is suitable for use according to the method of the invention.

A reproduction was made with a Xerox Model D Processor employing the photoreceptor described above. A good quality reproduction was obtained.

Although the invention has been described with respect to specific preferred embodiments, it is not intended to be limited thereto but rather those skilled in the art will recognize that variations and modifications may be made therein which are with the spirit of the invention and the scope of the claims.

What is claimed is:

1. An electrophotographic imaging method comprising:

(a) providing a photoreceptor comprising in the stated order (i) a substrate;

(ii) a layer of a charge carrier injecting material capable of injecting one species of charge carrier into the transport layer described in (iii) below in the presence of an electrical field and in the absence of illumination;

(iii) a layer of a charge carrier transport material capable of transporting at least one species of charge carrier and injecting one species of charge carrier into the layer of charge carrier generating material described in (iv) below;

(iv) a layer of charge carrier generating material which is capable of injecting photogenerated charge carriers of one species into said charge carrier transport material, subject to the provision that the charge carriers travel across the interface between the transport and generating layer in both directions; and (v) a layer of electrically insulating material;

(b) charging said photoreceptor with electrostatic charges of a first polarity;

(c) charging said photoreceptor with electrostatic charges opposite in polarity to said first polarity in order to substantially neutralize the charges residing on the surface of said photoreceptor; and (d) exposing said photoreceptor to an imagewise pattern of electromagnetic radiation to which said charge carrier generating material is responsive whereby there is formed an electrostatic latent image within said photoreceptor.

2. The method as defined in claim 1 wherein said charge carrier injecting layer is capable of injecting one species of charge carrier into said transport layer when irradiated with activating electromagnetic radiation and wherein step (b) further includes uniformly irradiating said injecting layer with activating electromagnetic radiation simultaneous with or subsequent to charging said photoreceptor with electrostatic charges of a first polarity.

3. The method as defined in claim 1 wherein said first polarity is negative and said second polarity is positive.

4. The method as defined in claim 1 wherein the rate at which said charge carrier injecting material injects into said charge carrier transport material exceeds the rate at which said injected charge carriers are transported by said charge carrier transport material.

5. The method as defined in claim 1 wherein the rate at which said charge carrier injecting material injects charge carriers into said charge carrier transport material greatly exceeds the rate at which said injected charge carriers are transported by said charge carrier transport material.

* * * * *